US007866170B2

(12) United States Patent
Boer et al.

(10) Patent No.: US 7,866,170 B2
(45) **Date of Patent: *Jan. 11, 2011**

(54) METHOD FOR COOLING DRINKS AND BEVERAGES IN A FREEZER AND REFRIGERATOR USING SUCH METHOD

(75) Inventors: Alessandro Boer, Cassinetta di Biandronno (IT); Raffaele Paganini, Varese (IT); Enrico Bellinetto, Azzate (IT); Cristiano Pastore, Borgomanero (IT); Fabio Gastaldello, Malnate (IT); Teresa Vitale, Torre Maggiore (IT)

(73) Assignee: Whirlpool Corporation, Benton Harbor, MI (US)

( * ) Notice: Subject to any disclaimer, the term of this patent is extended or adjusted under 35 U.S.C. 154(b) by 1014 days.

This patent is subject to a terminal disclaimer.

(21) Appl. No.: 11/539,190

(22) Filed: Oct. 6, 2006

(65) Prior Publication Data

US 2008/0202133 A1 Aug. 28, 2008

(30) Foreign Application Priority Data

Oct. 10, 2005 (EP) ..... 05109380

(51) Int. Cl.
*F25B 49/00* (2006.01)
*G01K 13/00* (2006.01)

(52) U.S. Cl. ..... 62/126; 62/130; 62/129

(58) Field of Classification Search ..... 62/126, 62/129, 130, 157, 389
See application file for complete search history.

(56) References Cited

U.S. PATENT DOCUMENTS

| | | | | |
|---|---|---|---|---|
| 5,884,491 | A | 3/1999 | Kim et al. | |
| 6,158,277 | A * | 12/2000 | Artzt et al. | 73/159 |
| 7,596,432 | B2 * | 9/2009 | Boer et al. | 700/300 |
| 2002/0039379 | A1 | 4/2002 | Ukai | |
| 2002/0112488 | A1 * | 8/2002 | Daum et al. | 62/125 |
| 2005/0132725 | A1 * | 6/2005 | Menten et al. | 62/126 |
| 2007/0157637 | A1 * | 7/2007 | Ferragut, II | 62/126 |
| 2008/0115511 | A1 * | 5/2008 | Barone et al. | 62/62 |
| 2008/0134697 | A1 * | 6/2008 | Tonon | 62/125 |

FOREIGN PATENT DOCUMENTS

| | | | |
|---|---|---|---|
| EP | 1564513 | A | 8/2005 |
| IT | EP1564513 | A * | 8/2005 |

* cited by examiner

*Primary Examiner*—Chen-Wen Jiang
(74) *Attorney, Agent, or Firm*—John W. Morrison; Diederiks & Whitelaw PLC

(57) ABSTRACT

A method for cooling a bottle in a freezer compartment of a refrigerator includes sensing the temperature of a zone of the freezer in which the bottle is placed, estimating the temperature of the bottle on the basis of the compressor status and of the sensed temperature of the zone, and informing the user when the estimated temperature of the bottle has reached a set value. The method can also be used for an automatically adjusted "shock freezing" process for any kind of food.

10 Claims, 7 Drawing Sheets

(a)

(b)

| run | Freezer Load [-1 = Empty, 1 = 25Kg] | Textern = T0 [-1=25 +1=32 °C] | T0_probe [-1=-24°C, +1=-1°C] | Bottle size [-1=0.5 lt +1=1.5lt] | Com0 [-1=off +1=on] | Damper0 [-1=off +1=on] | Door opening time [-1=15 sec. +1=45 sec] | Damper state [-1=closed +1=open] | Actual chilling time [sec] |
|---|---|---|---|---|---|---|---|---|---|
| 1 | -1 | -1 | -1 | -1 | -1 | -1 | -1 | -1 | 2140 |
| 2 | -1 | 1 | -1 | 1 | -1 | 1 | 1 | -1 | 4249 |
| 3 | 1 | -1 | -1 | -1 | -1 | 1 | 1 | 1 | 2406 |
| 4 | 1 | 1 | -1 | 1 | -1 | -1 | -1 | 1 | 4241 |
| 5 | 1 | 1 | 1 | -1 | -1 | -1 | 1 | -1 | 3100 |
| 6 | 1 | -1 | 1 | 1 | -1 | 1 | -1 | -1 | 3231 |
| 7 | 1 | 1 | -1 | -1 | 1 | 1 | -1 | -1 | 2971 |
| 8 | 1 | -1 | -1 | 1 | 1 | -1 | 1 | -1 | 3200 |
| 9 | -1 | -1 | 1 | -1 | 1 | 1 | 1 | -1 | 2140 |
| 10 | -1 | 1 | 1 | 1 | 1 | -1 | -1 | -1 | 4240 |
| 11 | 1 | -1 | 1 | -1 | 1 | -1 | -1 | 1 | 2350 |
| 12 | 1 | 1 | 1 | 1 | 1 | 1 | 1 | 1 | 4411 |

Figure 13

| | |
|---|---|
| a0 | 3.75 |
| a1 | 16.72 |
| a2 | 2.53 |
| a3 | -0.77 |
| a4 | -1.46 |
| a5 | -2.73 |
| b0 | 3211 |
| b1 | 457 |
| b2 | 557 |

Figure 14

METHOD FOR COOLING DRINKS AND BEVERAGES IN A FREEZER AND REFRIGERATOR USING SUCH METHOD

BACKGROUND OF THE INVENTION

1. Field of the Invention

The present invention relates to a method for cooling a container in a refrigerator comprising a refrigeration circuit including a compressor, as well as a refrigerator carrying out this method.

2. Description of the Related Art

In the present description the terms "container" and "bottle" have an equivalent meaning since the method according to the invention can be used for any kind of containers, of any materials, and with any contents, but being particularly useful for beverages contained in bottles. The terms "food" and "beverages" will be used to refer to the content of the container.

It is well known that consumers often use the freezer to rapidly chill their drink bottles. If the bottles are left in the freezer for too long the liquid may freeze and break the bottle. On the other hand if the user takes the bottle out too early, the drink may not be chilled enough. To address these kinds of problems, some freezers provide a "fast chiller" or "party mode" feature. This usually consists of a timer engaged by the user when the bottle is loaded in the freezer. After a fixed time it usually informs the user that the chilling process is over by using an acoustic signal. The chilling period is set short enough to prevent even the smallest bottles from freezing and breaking. In any case this time is not based on the actual drink temperature. So, at the end of the chilling process, the user can find the bottle too cold or not chilled enough.

SUMMARY OF THE INVENTION

One aspect of the present invention is to provide a more precise bottle chilling method in which the duration of the process is not based on a fixed timer.

According to another aspect of the invention, the chilling method comprises the steps of:

1) sensing the temperature of a zone of the refrigerator in which the container is placed,
2) estimating the temperature of the container on the basis of the compressor status and of the sensed temperature of the zone,
3) informing the user when the estimated temperature of the drink inside the container has reached a preset value.

According to the above features, the duration of the chilling process is tuned on the basis of an estimation of the actual drink temperature. This allows the user to find the drink at the right temperature at the end of the process.

The invention comprises an estimation and prediction algorithm that estimates the actual temperature of the drink and its thermal mass using a temperature sensor located in the same cavity where the bottle is placed. The estimation is used to tune the chilling time so that the user can find his drink at the right temperature at the end of the process. The estimation algorithm can be designed on the basis of a mathematical model that describes the heat exchange process between the real sensor area and the bottle area. Kalman filtering or maximum likelihood techniques can be used for this kind of application. The estimation algorithm receives as an input the actuation variable (i.e. the actual status of the compressor, for instance its speed in the case of variable speed compressor or its ON or OFF state) and uses it to integrate the model equations with the following purposes:

predicting the next sensor temperature measure y(k+1).

estimating the bottle temperature $y_b(k+1)$ estimating the bottle thermal mass $C_b(k+1)$ At each step, the algorithm calculates the prediction error e(k) as the difference between the sensor temperature measure y(k) and its estimation y(k). This difference is used as additional input (besides the actuation variable) to refine the next step estimations y(k+1), $y_b(k+1)$, $C_b(k+1)$.

BRIEF DESCRIPTION OF THE DRAWINGS

Further details and features of the present invention will be clear from the following description of a preferred embodiment, with reference to the attached drawings in which:

FIG. 13 shows a table reporting the conditions at which the described black box estimation algorithm has been tested to obtain the results shown in FIG. 12; and FIG. 14 shows a table reporting the coefficient values of the black box estimation algorithm according to an example of the invention.

DETAILED DESCRIPTION OF THE PREFERRED EMBODIMENTS

Figure 1:
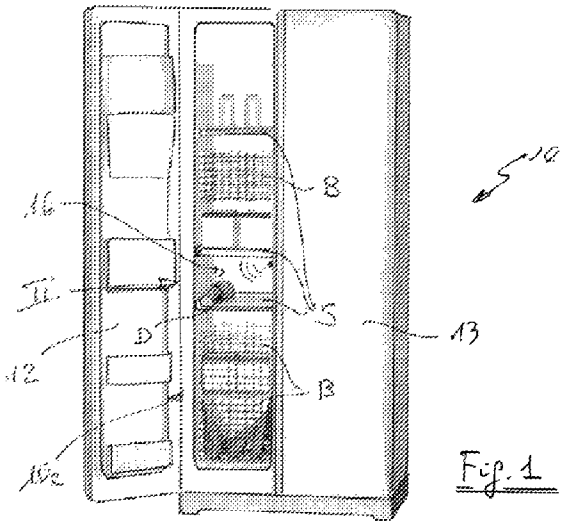
FIG. 1 is a perspective view of a refrigerator according to the invention.
Figure 2:
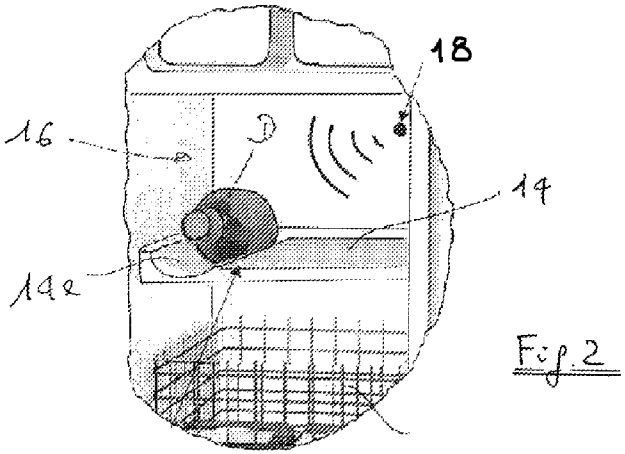
FIG. 2 is a enlarged detail of FIG. 1.
Figure 3:
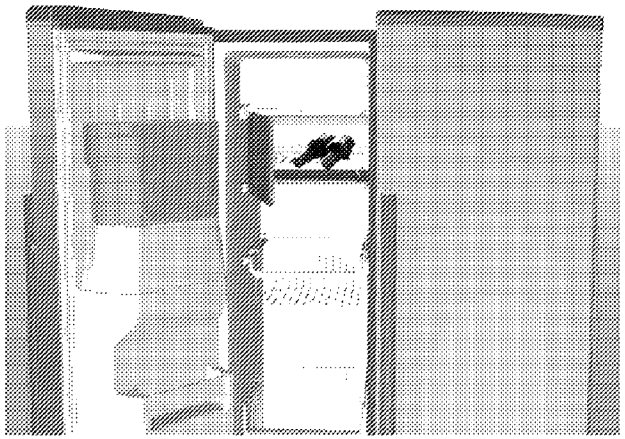
FIG. 3 shows a dedicated compartment inside the freezer cavity, used for the fast bottle chilling, according to the present invention.
Figure 4:
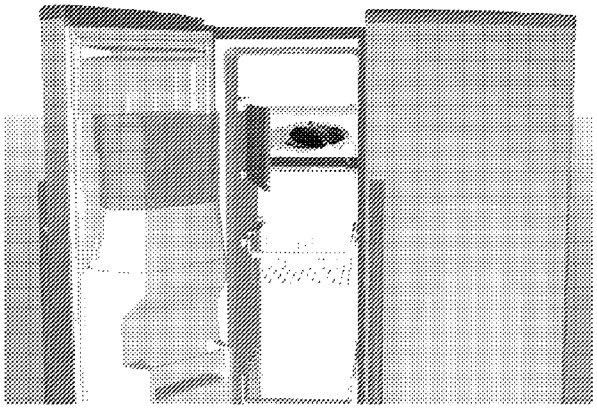
FIG. 4 shows a dedicated compartment inside the freezer cavity, used for the fast food freezing ("shock freezing") according to the present invention.

A side by side refrigerator 10 comprises a freezer cavity 10*a* closed by a door 12 and placed on the side of a fresh food cavity closed by a door 13. The freezer cavity presents shelves S and baskets B for storing different food products. A particular shelf, indicated in the drawings with the reference 14, presents a shaped seat 14*a* corresponding to a curved shape of a bottle D so that it can be placed on the shelf in a horizontal position. In the compartment defined by the shelf 14 and by another shelf positioned above it, indicated in the drawings with reference 16, a temperature sensor 18 is placed.

The solution according to the invention requires a description of the heat exchange process in term of mathematical equations. We will call this solution a "model based" solution. Other solutions, based on "black box" approaches can be used in describing the phenomenon and designing the estimation. In this case, the estimation algorithm would be based on a set of empirical relations (instead of a mathematical model) between the measured variable (i.e. the temperature sensor measure and the compressor speed or its ON/OFF state) and the estimated variables (bottle thermal mass, drink temperature). These solutions can be based on fuzzy logic and/or neural network techniques.

The usage of these kinds of advanced techniques (Kalman filtering, fuzzy logic, neural networks) can provide precise drink temperature estimation without particular constraints in the location of the temperature sensor 18. For this reason, a very cost-effective solution can consist on the use of the standard temperature sensor (normally used for the temperature control of the cavity) as temperature sensor 18 for the above estimation.

Figure 8:
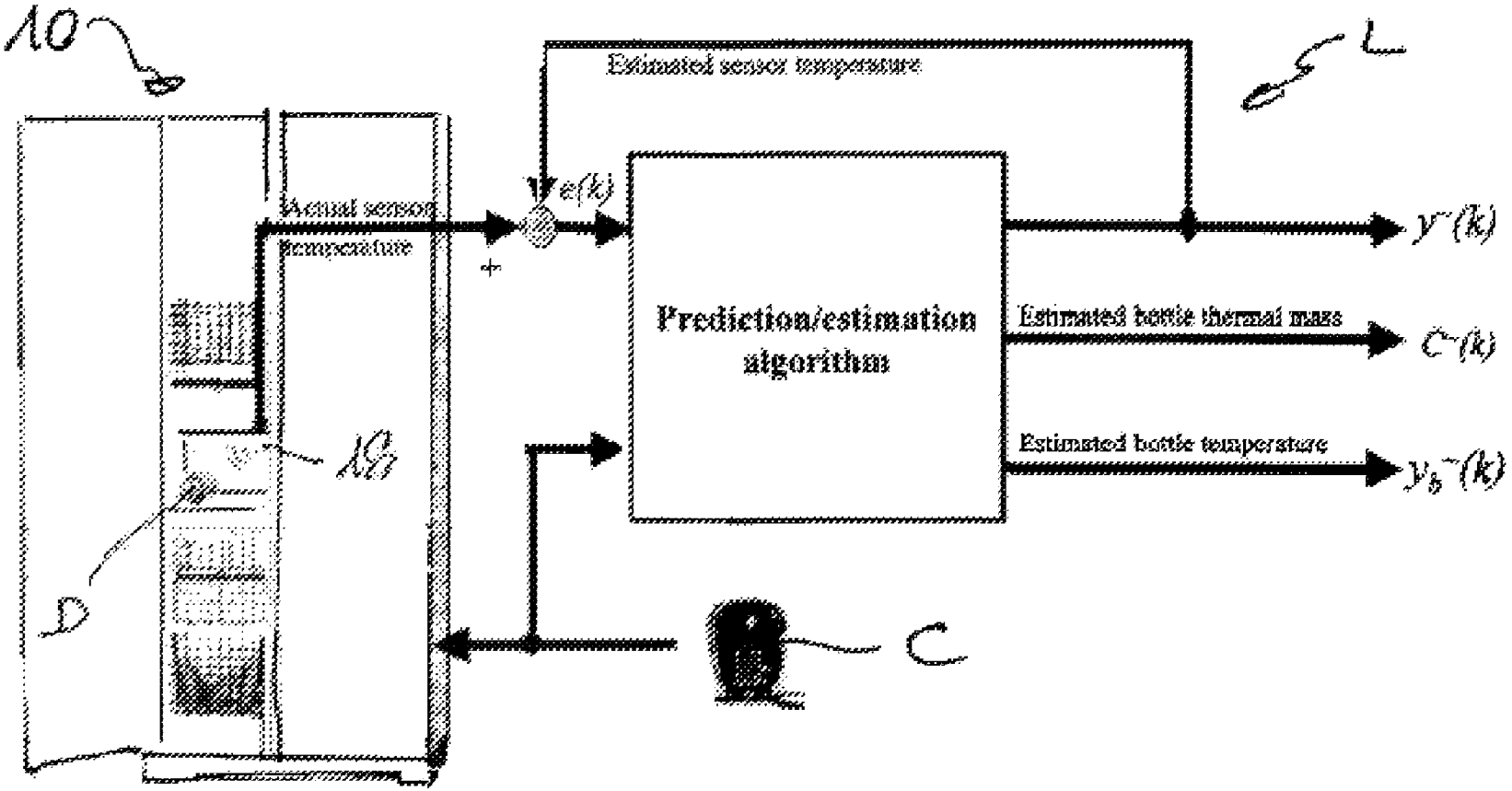
FIG. 8 shows a block diagram of the estimation algorithm according to a first embodiment of the invention.

In FIG. 8 it is shown how a "model based" algorithm according to the present invention works. The input data are the temperature measured by the sensor 18 and the status of the compressor C, i.e. its speed or its ON/OFF state. The output data of the algorithm are an estimated sensor temperature y(k), the estimated bottle thermal mass $C_b(k)$ which is continuously updated during the chilling process and the estimated bottle temperature $y_b(k)$. The estimated sensor temperature is used in a feedback control loop L for calculating the error e(k) between the estimated sensor temperature and the actual temperature. The algorithm resides in the electronic circuit used for controlling the refrigerator. An example of the application of the model based estimation algorithm consists in providing a dedicated compartment 16 for the chilling process where a cool forced air flow is blown and the drink (or food) temperature inside the compartment 16 is estimated through an energy balance between the inlet air flow temperature and the outlet air flow temperature.

Figure 9:
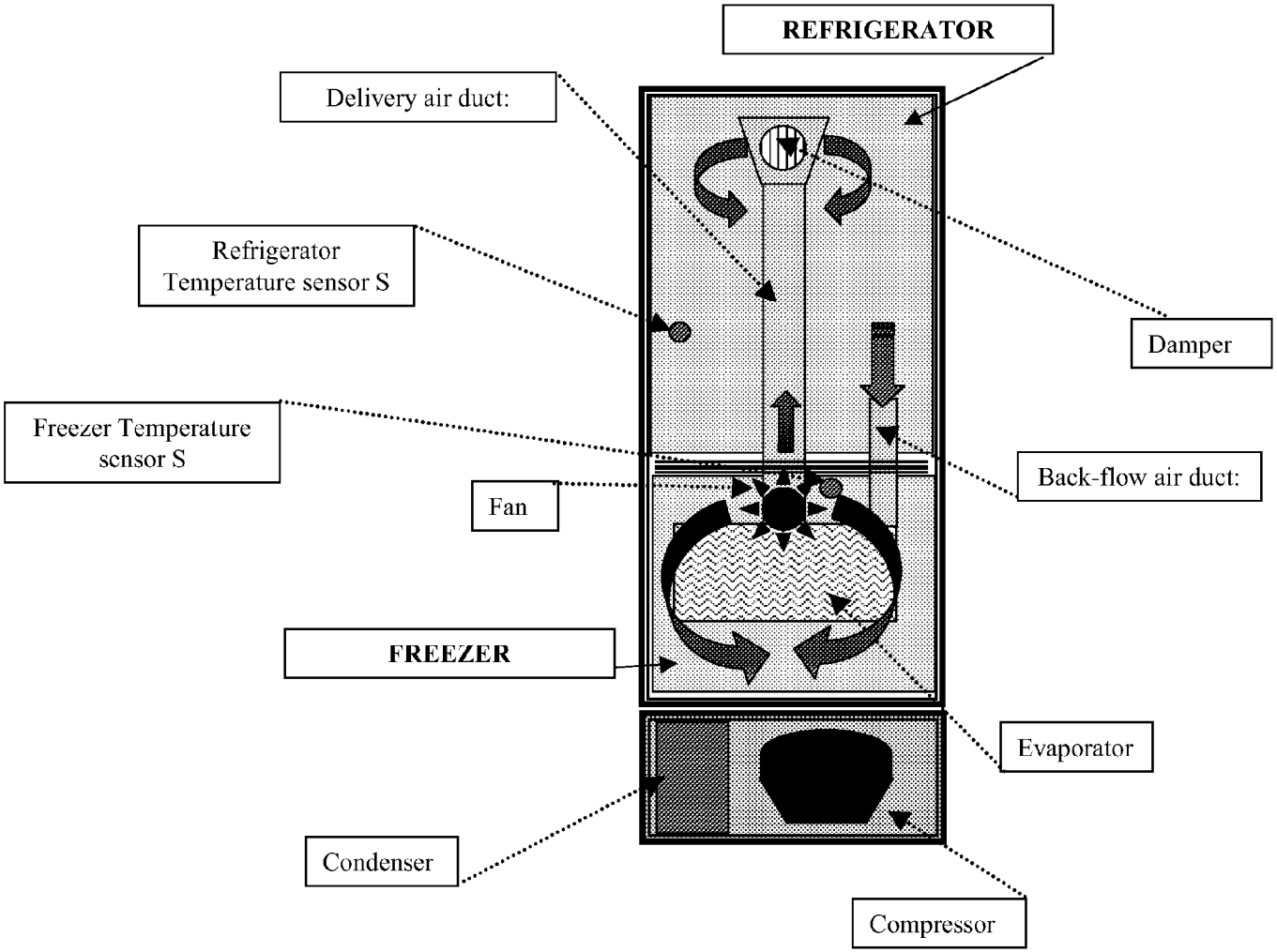
FIG. 9 is a schematic view of a refrigerator to which the estimation algorithm according to the invention has been applied.

An alternative to the "model based" approach in the estimation algorithm design is a "black box" based solution, an example of which will now be described. An estimation algorithm able to detect the instant when the loaded warm food reaches the desired temperature will be described. In this embodiment the algorithm is applied to the drink chilling function so it is used to inform the customer when the drink has reached the desired temperature. A schematic representation of the system is shown in FIG. 9. While a bottom mount refrigerator is shown in FIG. 9, it should be understood that the invention may be applied to other types of refrigerators, such as top mount or side by side configurations. The cold source is the evaporator placed inside the freezer cavity and cooled by the compressor. The freezer cavity is cooled by the forced air moved by the fan from the evaporator. The refrigerator cavity is cooled by the same fan when the damper is open.

The estimation of the bottle or container temperature can be carried out by measuring and processing, through an energy balance, the temperature of the air flow entering in the cavity (inlet air flow) and the outlet air flow.

Figure 10:
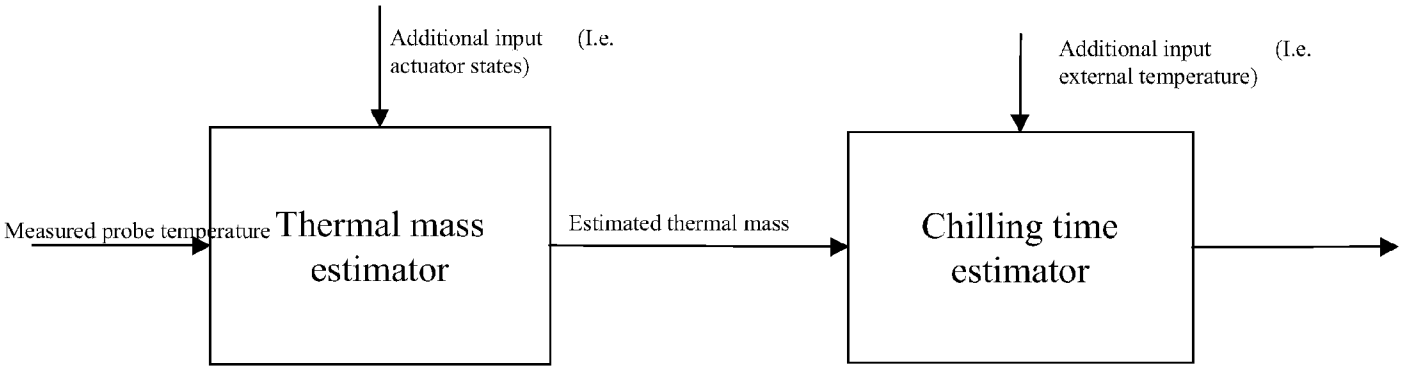
FIG. 10 shows a block diagram representation of a "black-box" estimation algorithm according to a second embodiment of the invention.

Test results prove that the drink chilling time is mainly affected by the drink thermal mass defined as the drink mass multiplied by its absolute temperature T0 at the instant of the introduction inside the cavity. This means that a possible approach in the chilling time estimator design can consist in estimating the bottle thermal mass when the bottle is introduced in the cavity and converting it into a chilling time through an appropriated formula. To simplify the description we will assume that the drink temperature T0 at the introduction instant is "close enough" to the environment temperature where the appliance is placed and it can be directly measured by a dedicated sensor or easily estimated for example by correlating the compressor run time with the internal temperature. Assuming this, the problem of the bottle thermal mass estimation can be reduced to the estimation of the bottle mass M (Kg). Once the bottle mass has been estimated, it is converted into a chilling time, according to the initial temperature (corresponding approximately to room temperature). This is summarized by the block diagram in FIG. 10.

In this specific example the bottle mass is computed according to the present formula:

$$\hat{M}=Q(a_0+a_1\cdot y+a_2\cdot T\text{probe}0+a_3\cdot\text{Damper}0+a_4\cdot\text{Damper}+a5\cdot\text{Com}0)$$

where:

$\hat{M}$=equivalent drink bottle mass, linearly transformed so that −1 represents a bottle of 0.5 liters of water, +1 represents a bottle of 1.5 liters of water.

Com0=compressor state at the bottle introduction instant [−1=off, +1=on]

Damper0=damper state at the bottle introduction instant [−1=closed, +1=open]

Damper=damper state during the bottle chilling process [−1=closed, +1=open]

Tprobe0=measured probe temperature at the bottle introduction instant, linearly transformed so that −1 refers to a measured probe temperature equal to about −24° C. and +1 refers to about −21° C.

y=average time derivative of the measured probe temperature [° C./sec.]

Figure 11:
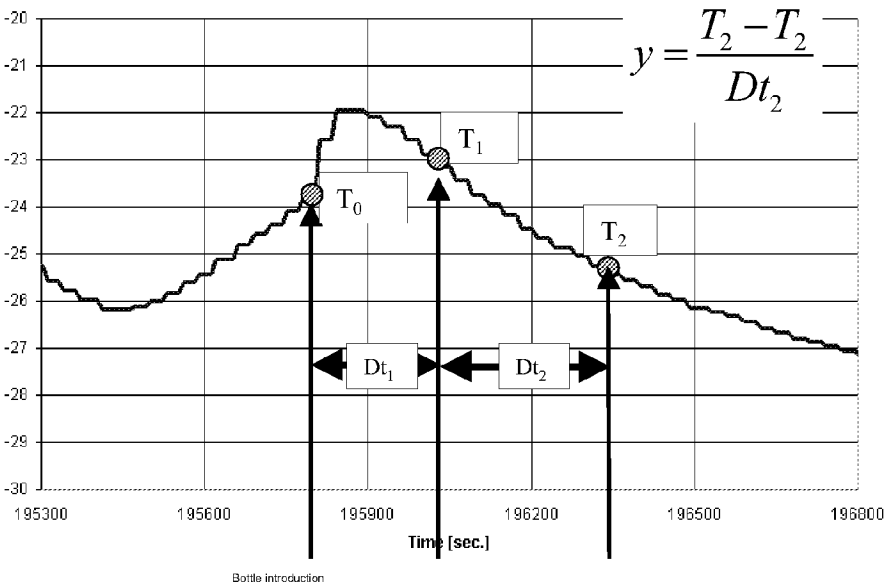
FIG. 11 shows a graphical representation of a possible way to calculate the average derivative of the probe temperature sensor with the purpose of estimating the thermal mass of the bottle or container.

The average time derivative of the probe temperature y is calculated according to the FIG. 11.

The function $Q_{25}$ is a non linear function that "quantifies" the equivalent thermal mass estimation according to the following non linear formula:

$$Q(x)=\begin{cases}-1.5 & \text{if } x\le -1.5\\ 0 & \text{if } -0.25\le \times \le 0.25\\ 1.5 & \text{if } x\ge 1.5\\ x & \text{else}\end{cases}$$

The bottle thermal mass is converted into the estimated chilling time by the second block according to the present formula:

$$D\hat{T}_{10}=b_0+b_1\cdot T\text{env}+b_2\cdot\hat{M}$$

where $D\hat{T}_{10}$=Estimated chilling time to reach the target temperature (in this example we assume a fixed target temperature equal to approximately 10° C.).

$T_{env}$ represent the external temperature linearly transformed so that −1 represents about 25° C., +1 represents about 32° C.

The numerical values of the coefficients $a_i$, $b_j$ relating to the present implementation are reported in FIG. 14.

The present solution uses the probe temperature derivative y as a probe temperature attribute to estimate the bottle mass. This has been done because tests results proved that this derivative is the main signal factor which is correlated with the bottle mass. This dependency is mainly related to the distance between the sensor position and the bottle position. In this specific case, referring to the appliance shown in FIG. 9, the sensor was placed on the top of the freezer cavity and the first drawer on the top was chosen as bottle location. The closer the bottle is to the sensor, the more correlated are the probe temperature signal and the bottle mass. Other shape factors on the probe temperature can be used in the estimation of the bottle mass, depending on the probe position. Typical shape factors used by black box algorithm are: peak, integral, power spectrum.

Figure 12:
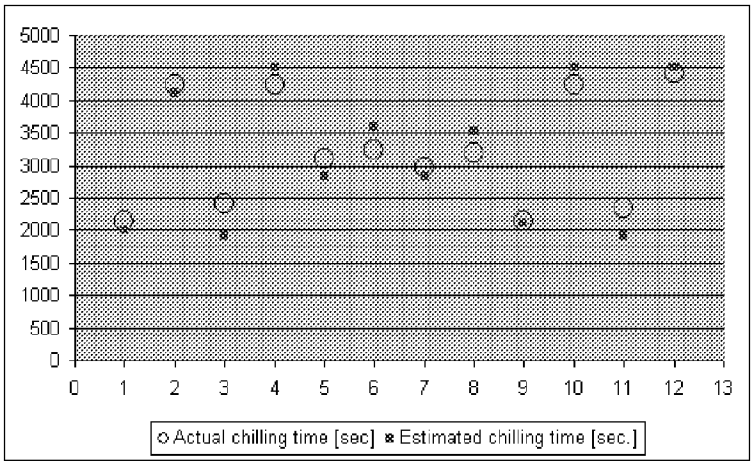
FIG. 12 shows the performances of the black box estimation algorithm according to the invention in terms of precision of chilling time estimation (a) and in terms of final chilling temperature error in the considered test conditions (b)
Figure 12:
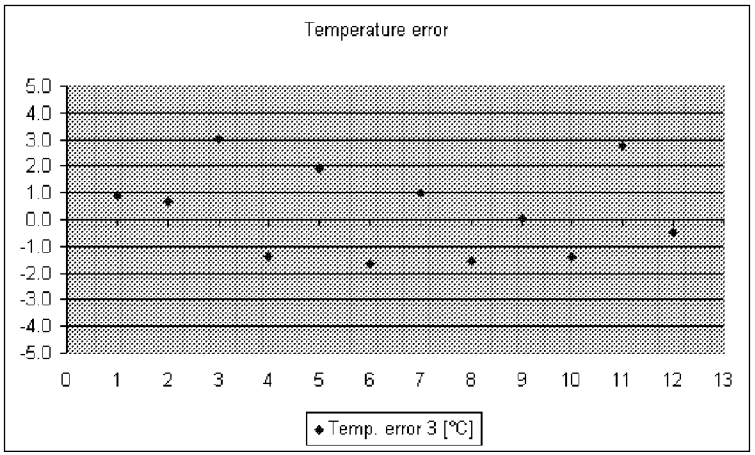

FIG. 12 shows the results of the presented estimator in a set of test conditions listed in FIG. 13. More specifically, upper portion (a) of FIG. 12 compares the actual time taken by the bottle to reach the target temperature (about 10° C. in this case) and the estimated time according to the estimator. Lower portion (b) of FIG. 12 shows the error temperature as the difference between the drink temperature after the estimated chilling time and the target temperature (about 10° C.)

Figure 6:
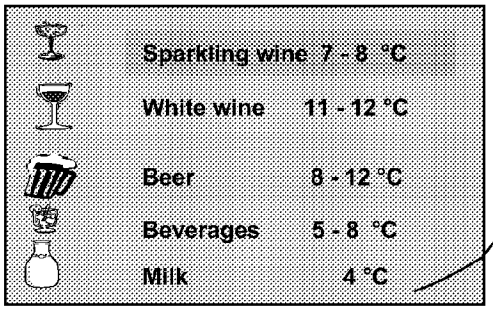
FIGS. 5-7 are views of the user interface of a refrigerator according to the invention.
Figure 7:
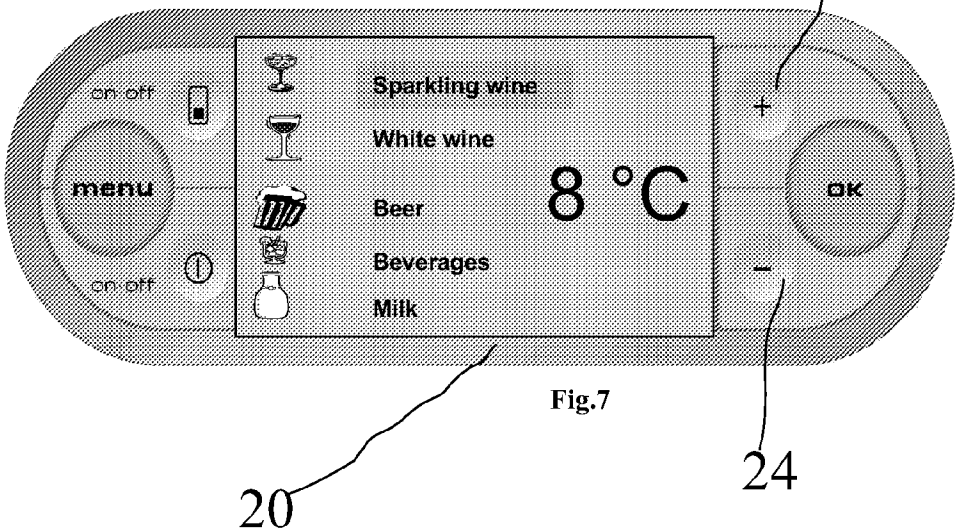
Figure 5:
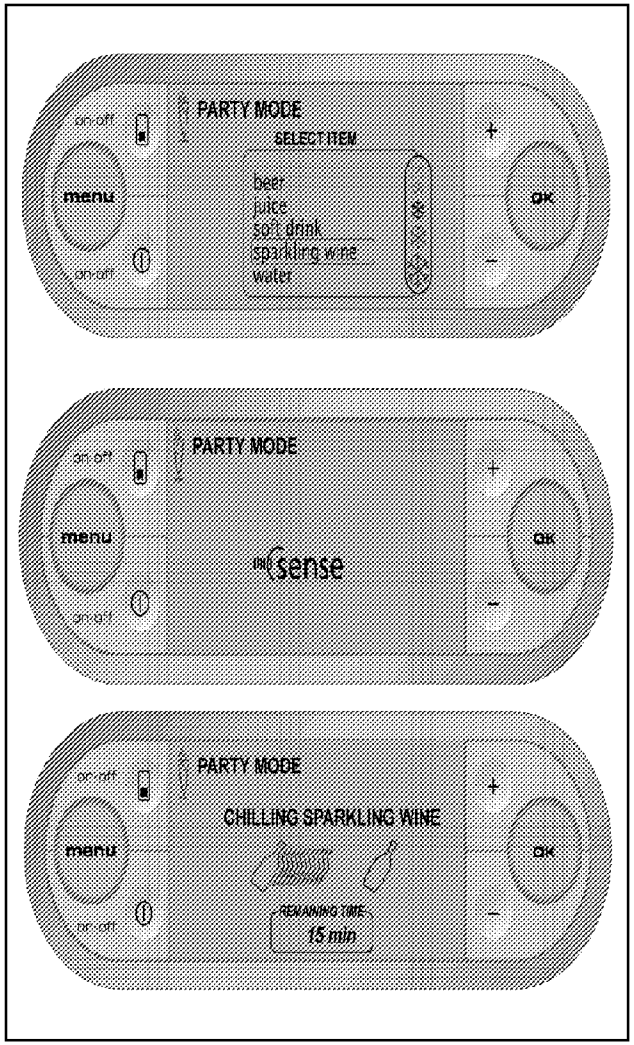

In addition to the estimation algorithm, another part of the invention relates to the user interface 20 (FIGS. 5-7). It allows the user to interact with the refrigerator 10 and it shows the status of the chilling process.

Several solutions of user interface are possible, and some of them are shown in the attached FIGS. 5-7. For example the user-interface can show the estimated drink temperature and/or the remaining chilling time. In FIG. 5 a sequence of different configurations of the user interface 20 is shown. In the upper view, the user can select the item to be chilled. For each item it is possible to have also an indication of the optimal range of temperatures, as shown in FIG. 6. Once the user has selected the item, the user interface (middle view) shows that the refrigerator is in a sensing mode. In the lower view, the user interface shows the name of the selected item and the remaining time for reaching the optimal temperature. In FIG. 5 we represented the case of remaining chilling time indication, however the case of estimated drink temperature indication must be considered part of the invention as well. When the user engages the chilling function, he can set the desired drink temperature. This could be done by indicating the temperature (through up and down buttons 22 and 24 respectively) or by indicating the kind of drink to chill. In this second case, the control algorithm automatically decides the most desirable temperature for the selected kind of drink. Alternatively the control could suggest the most desirable target temperature for the selected drink temperature and additionally give the customer the possibility to adjust the desired temperature (FIG. 7).

The information at the end of the chilling process can be communicated locally (on the user-interface 20 and/or by means of an acoustic signal) or it can be sent to a remote device.

The present invention provides a more precise chilling process so that the user can provide the drink at the right temperature at the end of the process. The main advantage comes from the usage of advanced estimation techniques that can avoid the usage of an additional hardware sensor inside the cavity. The standard sensor normally used for the cavity temperature control can be used. Although the method has been disclosed in association with a freezer cavity, the method can also be applied for the cooling of a container in the fresh food compartment, with the potential advantage to avoid risk of freezing the bottle.

The present invention has been described considering the drink chilling process as a possible application. It should be recognized that the invention may be equally applied to the chilling of food items inside a freezer/refrigerator cavity to reach a predetermined temperature.

The invention has been described allowing for the warm food (or the drink bottle) to be inserted in the freezer cavity and using the traditional temperature sensor to estimate the chilling time, without further impact to the traditional structure of the appliance (no additional sensor or actuators). This has been done to highlight the potential cost-effective advantage obtainable by using advanced estimation techniques to convert the rough temperature signal coming from the traditional sensor into an estimation of the drink thermal mass. However, it should be recognized that the invention can be applied to a dedicated compartment with dedicated sensor and actuators. This special compartment, for example, can provide a set of different features enabled by the estimation algorithm. The drink chilling time can be one of these features. Another possible feature could regard the quick freezing process of warm food (shock freezing). The estimation algorithm, according to one of the described techniques, estimates the food thermal mass and the correspondent freezing time. During this estimated time, the appliance control will maximize the cooling power to speed-up the freezing process. Once the freezing time has elapsed, the customer is informed that the food is frozen. At this point the appliance control can keep the food at the correct temperature until the customer removes it. This feature has the advantage to freeze the food at high speed in order to maintain its organoleptic properties ("Shock freezing" process). The use of the mentioned estimator of the freezing time guarantees that the function will be active for only the time necessary to freeze the food avoiding any waste of energy.

The use of the algorithm according to the invention (either for drink chilling or for shock freezing) allows for drink chilling or food freezing speed to be maximized by maximizing the appliance cooling power (i.e. compressor speed, compressor run time, air flow . . . ) during the estimated chilling/freezing time.

The invention claimed is:

1. A method for cooling a container in a refrigerator comprising a refrigeration circuit including a compressor, the method comprising the steps of:

sensing a temperature of a zone of the refrigerator in which a container is placed;

estimating a temperature of the container on the basis of the compressor status and of the sensed temperature of the zone, and informing a user when the estimated temperature of the container has reached a preset value.

2. The method according to claim 1, further comprising the step of estimating a future temperature of the zone of the refrigerator, the estimated future temperature value being used together with a sensed future temperature value for calculating an error, the error being used as an additional input for estimating the temperature of the container.

3. The method according to claim 1, further comprising the step of estimating a thermal mass of the container.

4. The method according claim 1, wherein the estimating step is carried out by using a technique selected from the group consisting of Kalman filtering, maximum likelihood, fuzzy logic and neural networks.

5. The method according to a claim 1, wherein the preset temperature of the container is automatically selected on the basis of a content thereof.

6. A refrigerator comprising:

a cavity for loading a container;

a refrigeration circuit including a compressor for cooling the cavity;

a temperature sensor in the cavity for sensing a cavity temperature;

an electronic control for estimating a container temperature based on the compressor status and the sensed cavity temperature; and a user interface through which a user can set a desired container temperature, the user interface adapted to provide a signal to the user when the estimated container temperature has reached the desired container temperature.

7. The refrigerator according to claim 6, wherein the container is a drink container and the user can select the type of drink to be chilled, the electronic control being adapted to automatically select an optimal chilling temperature related to the selected drink type.

8. The refrigerator according to claim 7, wherein the user interface is adapted to allow the user to modify the automatically selected temperature.

9. The refrigerator according to claim 6, wherein the cavity for loading the container constitutes a dedicated compartment provided with dedicated temperature sensors and actuators.

10. The refrigerator according to claim 9, wherein the electronic control is adapted to maintain the container in the dedicated compartment at the desired temperature after the desired temperature is attained.

* * * * *